United States Patent [19]

Valencia

[11] 4,437,685

[45] Mar. 20, 1984

[54] BOOK INDEX MARKERS

[76] Inventor: José Valencia, 3329 Amy St., Apt. #4, San Francisco, Calif. 94110

[21] Appl. No.: 371,000

[22] Filed: Apr. 22, 1982

[51] Int. Cl.[3] ..... B42D 9/00; B42F 21/00

[52] U.S. Cl. ..... 281/42; 283/38; 116/234

[58] Field of Search ..... 283/35, 36, 37, 38, 283/41; 116/234; 281/45, 46, 42, 47, 48

[56] References Cited

U.S. PATENT DOCUMENTS

| | | | |
|---|---|---|---|
| 1,478,655 | 12/1923 | Hughes | 116/234 |
| 1,551,021 | 8/1925 | Fetters | 281/42 |
| 1,617,446 | 2/1927 | Gorin | 116/234 |
| 1,872,807 | 8/1932 | Posner | 116/234 |
| 2,177,348 | 10/1939 | Abbott | 116/234 |
| 2,194,576 | 3/1940 | Truesdale | 116/234 |
| 2,731,939 | 1/1956 | Fellabaum | 116/234 |
| 3,324,823 | 6/1967 | Peters | 283/38 |
| 3,561,147 | 2/1971 | Valencia | 283/38 X |

*Primary Examiner*—Paul A. Bell

*Assistant Examiner*—John S. Brown

*Attorney, Agent, or Firm*—Harvey B. Jacobson

[57] ABSTRACT

A book index marker combined with a book such as a telephone directory, dictionary or the like in which information is categorized alphabetically, numerically or the like with the index marker of the present invention providing readily observable indicia associated with the pages of the book which constitute the initial page of each category of information in the book. In one embodiment, the index marker is inserted between the pages of the book with the indexing indicia disposed above and below the top and bottom edges of the book with this embodiment being secured in place by an elastic band extending externally of the spine of the book or by anchoring elements engaging the spine of the book. In another embodiment of the invention, the index marker has the indicia disposed along the vertical free edges of the pages of the book and has a spine extendng outwardly of the spine of the book and secured thereto by a rubber band extending between the pages of the book adjacent the spine.

5 Claims, 10 Drawing Figures

10
12
14
16
18
20
22
24
26
28
30
32
34
36
38
40
41
42
44
4
6

BOOK INDEX MARKERS

BACKGROUND OF THE INVENTION

1. Field of the Invention

The present invention relates to book index markers and more particularly an assembly which can be combined with a book having information categorized therein alphabetically or numerically or in any other known sequence with the index marker of the present invention providing a readily attachable assembly which can be easily combined with the book and provide an easily observable index marker to enable the book to be easily opened to a predetermined category of information.

2. Description of the Prior Art

Many books, especially dictionaries, are provided with index arrangements in the form of recesses formed in the free edges of the pages with the recesses revealing alphabetical indicia or the like by which the book can be opened to a particular category of information. In addition, there have been provided index markers which can be associated with books not provided with an index marker such as a telephone directory or the like. My prior U.S. Pat. No. 3,561,147 discloses one such arrangement. In addition, the following U.S. patents disclose related structures:

| | |
|---|---|
| 143,075 | J. X. Hicks |
| 665,650 | V. H. Clymer |
| 952,185 | T. A. Chelson et al |
| 2,203,511 | A. A. Tait |
| 3,324,823 | R. J. Peters |
| 4,019,759 | B. M. Stanton |

While the above patents disclose index marker arrangements which can be associated with books in various combinations, the structures in the above mentioned patents are not specifically relevant to this invention.

SUMMARY OF THE INVENTION

An object of the present invention is to provide a book index marker which can be combined with an existing book without any modification of the book and which will not affect the normal handling and manipulation of the book during use.

Another object of the invention is to provide a book index marker inserted internally of the book and including a plurality of sheets of material secured together at one edge adjacent the spine of the book with the free edges of the sheets of material being shingled and having a length longer than the book with indicia being provided at the top and bottom edges of the sheets of material to provide an index such an an alphabetic index at both the top and bottom edges of the book with the connected edges of the sheets being secured to the spine of the book by a rubber band disposed externally of the spine of the book and connected to the end portions of the sheets or by a wire-type anchoring device attached to the sheets and engaging the outer surface of the spine of the book.

A further object of the invention is to provide a book index marker including a plurality of sheets of material bound together along one edge and having free edges of progressively increasing length with indicia to provide a shingled alphabetic index at the vertical edges of the book with the sheets being connected together at the opposite edges and disposed eternally of the spine of the book and being secured thereto by a rubber band extending through the interior of the book.

Still another object of the invention is to provide a book index marker in accordance with either of the immediately proceeding objects in which the sheets have large open areas enabling the pages of the book to pass therethrough in order to properly orient the sheets of the index marker in relation to the pages of the book so that the indicia on the sheets of material of the index marker will indicate a particular category of information in the book which commences on the page of the book immediately below the sheet of the index marker.

A still further object of the invention is to provide an index marker for books which is easy to install, easy to remove, effective for its purposes and relatively inexpensive to manufacture.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figures 1, 2, 3, 4, 5, 6:
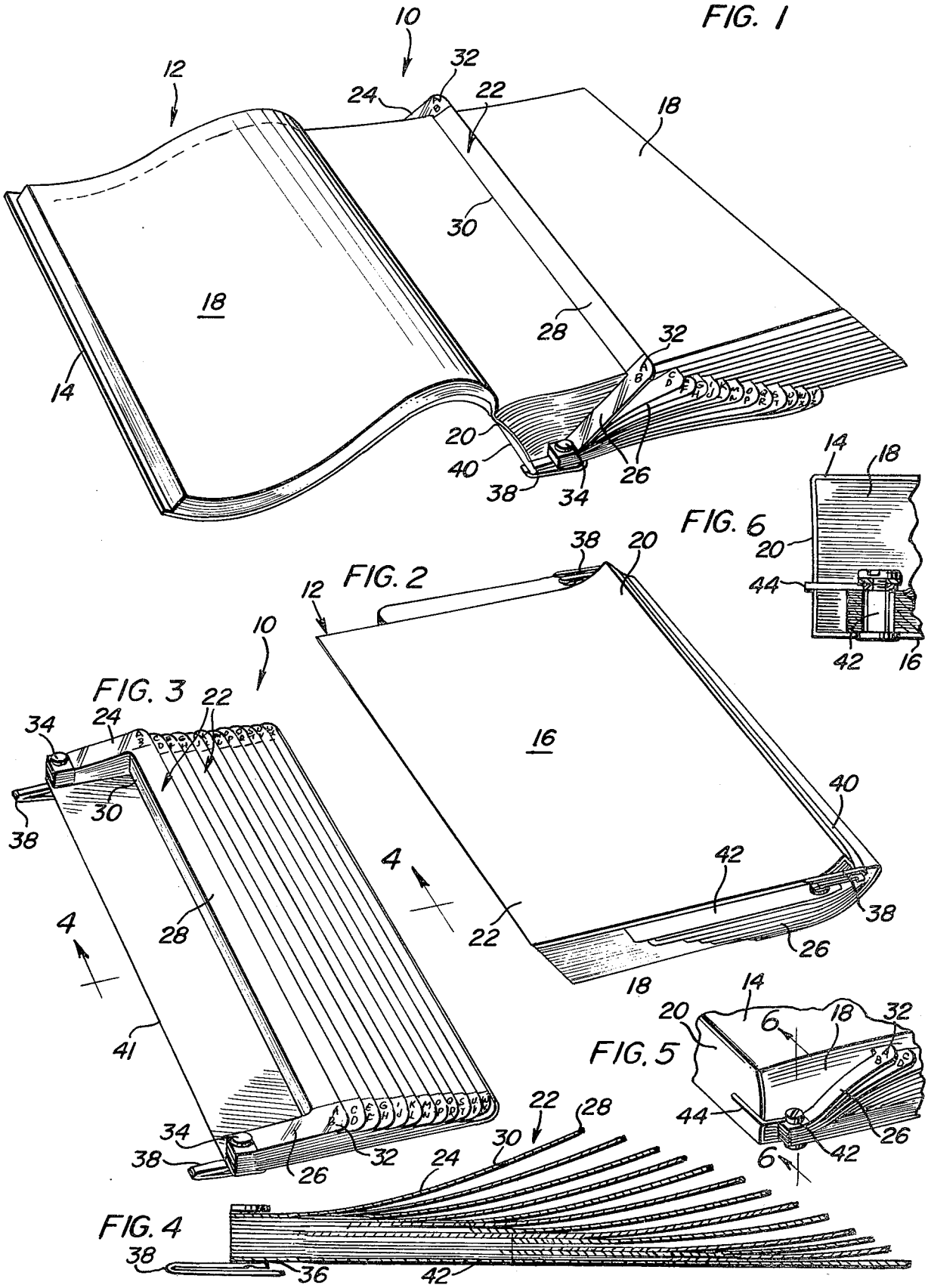
FIG. 1 is a perspective view of one embodiment of the invention installed on an open book.
FIG. 2 is a perspective view of the assembly of FIG. 1 in which the book has been inverted and the spine deflected to illustrate the rubber band retaining the index marker in position in the book.
FIG. 3 is a perspective view of the index marker.
FIG. 4 is a transverse sectional view taken substantially upon a plane passing along section line 4—4 of FIG. 3.
FIG. 5 is a fragmental perspective view illustrating another anchoring assembly which may be used with this embodiment of the index marker.
FIG. 6 is a vertical sectional view taken substantially upon a plane passing along section line 6—6 of FIG. 5 illustrating specific structural details of the anchoring assembly of FIG. 5.

Referring now specifically to the drawings, the embodiment of the index marker illustrated in FIGS. 1–6 is generally designated by numeral 10 and is associated with a book 12 such as a telephone directory, dictionary or any book having information categorized therein. The book 12 includes a front cover 14, a back cover 16, a plurality of pages 18 between the front and back cover with the pages and cover being connected or bound in a conventional manner to form a spine 20.

The index marker 10 is associated with the book 12 without requiring any modification of the book whatsoever and includes a plurality of sheets of material 22 which may be constructed of heavy paper, cardboard, plastic material or the like which is more durable than the material from which the pages 18 of the book are constructed but the sheets 22 are flexible and, as illustrated in FIG. 3, each of the sheets is of substantially U-shaped configuration including upper and lower legs 24 and 26 interconnected by a web portion 28 defining an open space 30. The web portion of the sheet 28 is of a length generally equal to or slightly greater than the distance between the top and bottom edges of the pages 18 of the book 12 so that the upper and lower legs 24 and 26 will be disposed outwardly of the top and bottom edges of the book respectively as illustrated in FIG. 1. As illustrated, the upper and lower legs 24 and 26 of the stack of sheets 22 are progressively longer thereby providing a shingled arrangement of the sheets 22 so that the upper and lower corners of the sheets 22 are observable and these corners are provided with indicia 32 in the form of alphabetic letters, numbers or the like with the indicia being a single letter, a group of letters or any other indicia arrangement desired.

The ends of the legs 26 are interconnected by a fastening device 34 so that the ends of the leg portions 24 and 26 of the sheets 22 are secured together. The fastener 34 which is a conventional self-piercing fastener with bendable legs or tines has a head at one end and a washer 36 is placed thereon and one of the legs or tines is longer than the other and is bent to form an attaching loop 38 to receive an endless rubber band 40 thereon. As illustrated, the bottommost sheet 22 is of rectangular configuration, that is, it is not provided with an open area. The index marker is positioned in the book so that the inner edge 41 of the lowermost sheet 22 is adjacent the interior of the spine 20. When so arranged, the loop 38 is disposed exteriorly of the ends of the spine 20 and the rubber band 40 extends along the rear surface of the spine 20 and is connected to the loops 38 as illustrated in FIGS. 1 and 2. The upper surface of the lowermost sheet 22 may be provided with instructional indicia or the like and, if desired, an additional solid sheet may be provided as the lowermost sheet so that additional information may be placed thereon if desired. While the lowermost sheet 22 will be position adjacent the back cover of the book, the loop will be positioned adjacent the central portion of the spine 20 so that the rubber band 40 will retain the marker in place. When installing the book marker, it is only necessary to position the uppermost sheet 22 above the page 18 having information thereon corresponding with the indicia 32 by inserting the free edges of the pages 18 through the open area 30 so that the web portion 28 of the sheets 22 will be properly oriented so that the indicia 32 will be properly related to the information on the page 18 of the book with which the web 28 of the sheet 22 will be associated. Thus, with the book closed, and it is desired to look at a particular category of the book, it is only necessary to locate the appropriate indicia 32, place the finger under either or both of the upper and lower corners of the sheet 22 and lift upwardly thereby opening the book to the desired category of information in the book. The legs or tines of the fastener 34 may be deformed or offset in any suitable manner to orient the loop 38 in a desired relationship to the spine of the book to assure that the index marker will be retained in position thereon.

FIGS. 5 and 6 illustrate a modified type of fastener 42 for securing the sheets 22 together which is in the form of a screw threaded assembly having an L-shaped wire member 44 connected thereto with the end of the L-shaped wire member 44 having a loop disposed under the head of the fastener 42. The fastener 42 includes an externally threaded screw member and an internally threaded socket, both of which have heads, and may be a conventional screw known as a "Chicago" screw. With this arrangement, the L-shaped wire member 44 will engage the external surface of the spine 20 of the book 12 to secure the index marker 10 in place. Also, an alternative assembly arrangement may be utilized by removing the screw fastener 42 and inserting the sheets 22 onto and between the pages 18 of the book 12 after which the screw threaded fastener 42 may be reassembled with the ends of the legs 24 and 26 of the sheets 22 thereby securing all of the sheets in position with the L-shaped member 44 being assembled on the fastener when it is assembled so that it will engage the spine of the book and retain the index marker 10 in the book when the fasten 42 is tightened securely.

Figure 7:
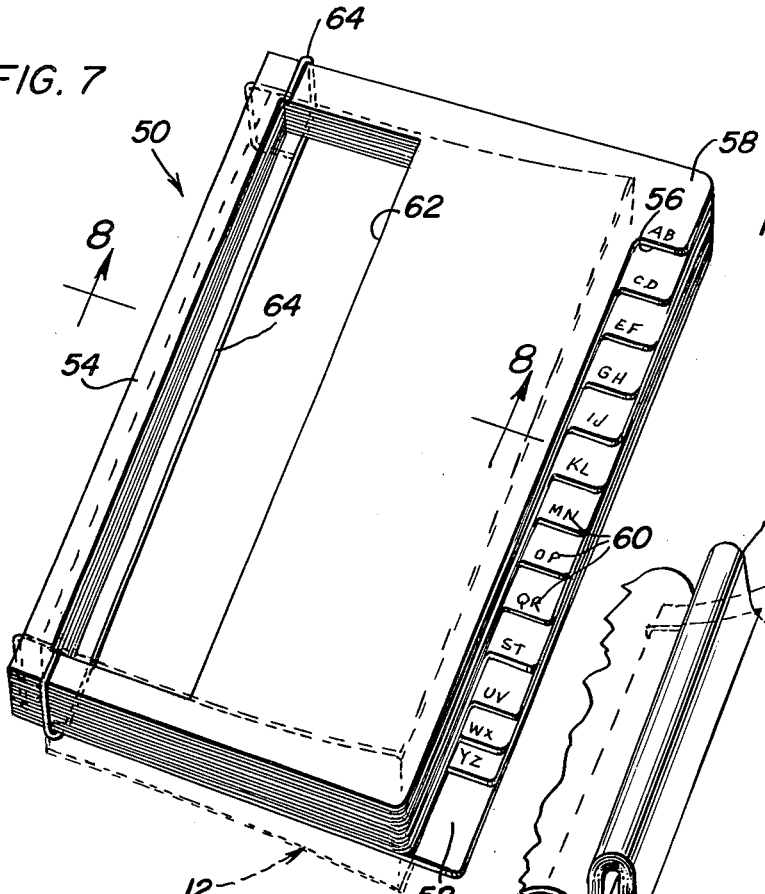
FIG. 7 is a perspective view of another embodiment of the invention with the book being illustrated in broken line.
Figure 9:
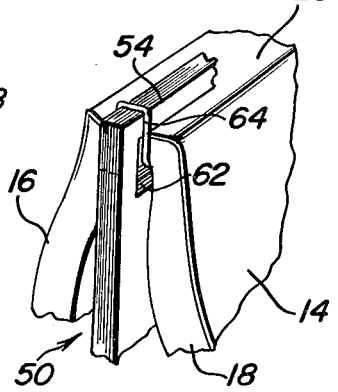
FIG. 9 is a fragmental perspective view of the index marker and book illustrating the association of the spine of the index marker and the spine of the book.
Figure 10:
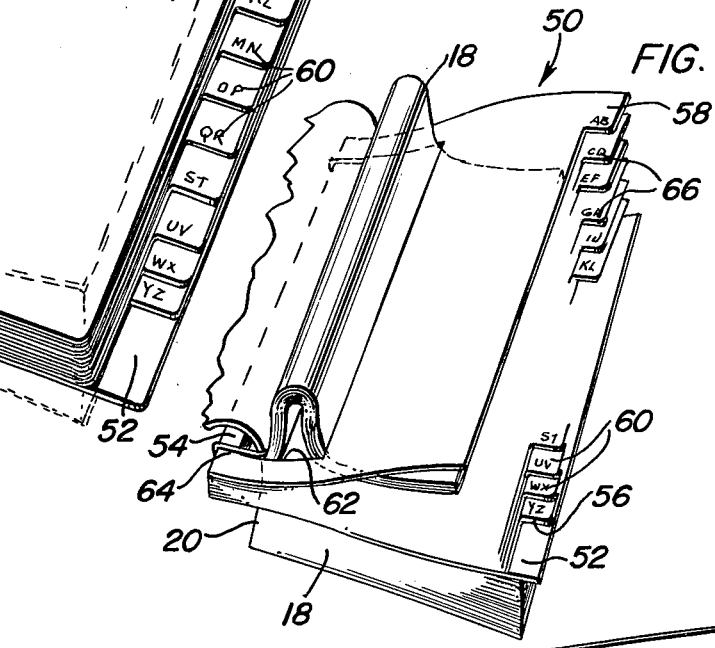
FIG. 10 is a fragmental perspective view illustrating the manner in which the index marker is installed on the book.
Figure 8:
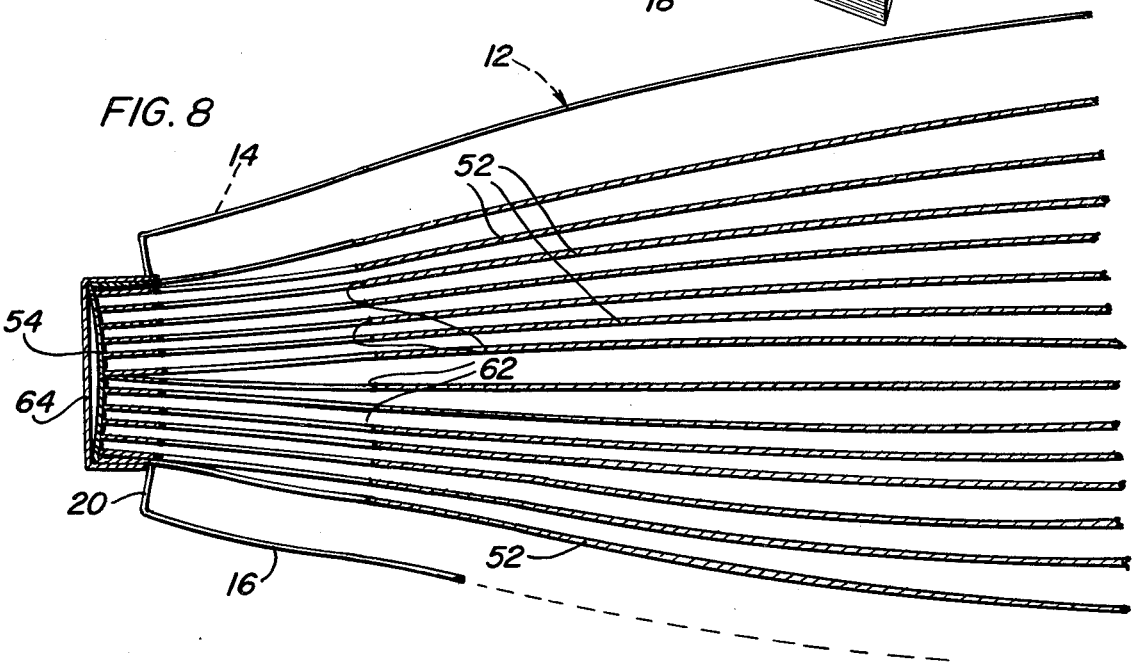
FIG. 8 is a transverse, sectional view, on an enlarged scale, taken substantially upon a plane passing along section line 8—8 of FIG. 7 illustrating further structural details of this embodiment of the invention.

FIGS. 7–9 illustrate another embodiment of the index marker designated generally by the numeral 50 which inludes a plurality of sheets 52 having vertical edges secured together to form a spine at 54 and the opposite vertical edges of the sheets 52 are provided with notches 56 defining tabs 58 of progessively increasing vertical length with indicia 60 on the lower end of each tab so that it is observable outwardly of the free edges of the pages of the book 12 when the index marker 50 is associated therewith. Each sheet 52 of the index marker 50 is provided with a generally rectangular, enlarged openings 62 adjacent the spine 54 to enable the pages 18 and the spine 20 of the book 12 to be inserted through the opening 62 with groups of the pages being interposed between the sheets 52 of the index marker 50 so that the indicia 60 on the tabs 58 will correspond with the initial page of the information in the book which corresponds with the indicia 60. When the index marker 50 is assembled onto the book 12, the spine 54 thereon rests against the spine 20 of the book and the pages 18 are received between adjacent sheets 52 with the free edges of the sheets 18 terminating inwardly of the tabs 58 as illustrated in broken line in FIG. 7 with FIG. 10 illustrating the manner in which the pages 18 are associated with the sheets 52. A rubber band 64 is inserted through the book 12 between pages 18 generally aligned with the top and bottom surfaces of the spine 54 and the rubber band 64 is positioned over the ends of the index marker and moved inwardly and the ends of the rubber band 64 are then pulled over the ends of the spine 54 to the position illustrated in FIG. 9 thereby securing the book and index marker in assembled relation. When it is desired to remove the index marker from the book, simply cut the rubber band and move the spine 54 out of alignment with the spine 20 and then move the index marker outwardly in relation to the pages of the book or if it is desired, the rubber band can be moved off the ends of the spine and then moved forwardly of the index marker and off the forward edges thereof after which the spine 54 then may be laterally deflected into a misaligned relation to the spine 20 and the index marker moved off the book by moving the spine 54 toward the free edges of the pages 18 along the surface of the book covers 14 or 16.

In each arrangement, the index marker may be quickly and easily assembled with respect to the book and easily removed therefrom when desired so that it can be used with various books such as telephone directories, city directories, dictionaries and the like. In each instance, the index marker provides quick and easy location of a desired category of information appearing in the book.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An index marker in combination with a book, said book having categorized information compiled on the pages thereof in a known sequence, said index marker comprising a plurality of sheets of material interleaved with the pages of the book and having a peripheral portion projecting beyond the pages of the book, said projecting portions including indicia corresponding with the sequence of categories on the pages of the book, said projecting portions being oriented in shingled relation to enable observation of the indicia and access to the projecting portions to facilitate opening the book to the desired page, and means removably securing the plurality of sheets to the book to enable easy assembly of the index marker with the book and removal therefrom for use with another book without damage to the pages of the book or the index marker, said means securing the sheets and book in assembled relation including a fastener extending through projecting peripheral portions of the sheets adjacent each end of the spine of the book, and book spine engaging means connected with said fasteners, said spine engaging means including a right angle rigid member having one leg engaging the exterior of the spine of the book and the other leg including an eye engaging the fastener, each fastener including a telescopic screw threaded post assembly to rigidly clampingly engage the eye of the anchor.

2. An index marker in combination with a book, said book having categorized information compiled on the pages thereof in a known sequence, said index marker comprising a plurality of sheets of material interleaved with the pages of the book and having a peripheral portion projecting beyond the pages of the book, said projecting portions including indicia corresponding with the sequence of categories on the pages of the book, said projecting portions being oriented in shingled relation to enable observation of the indicia and access to the projecting portions to facilitate opening the book to the desired page, and means removably securing the plurality of sheets to the book to enable easy assembly of the index marker with the book and removal therefrom for use with another book without damage to the pages of the book or the index marker, said sheets being generally U-shaped with webs positioned between the pages and legs positioned alongside and outwardly of the top and bottom edges of the pages of the book with the legs progressively increasing in length from front to rear to provide webs oriented in shingled relation with the indicia positioned at the junctures between the legs and webs and the pages of the books extending beyond all of the webs.

3. An index marker in combination with a book, said book having categorized information compiled on the pages thereof in a known sequence, said index marker comprising a plurality of sheets of material interleaved with the pages of the book and having a peripheral portion projecting beyond the pages of the book, said projecting portions including indicia corresponding with the sequence of categories on the pages of the books, said projecting portions being oriented in shingled relation to enable observation of the indicia and access to the projecting portions to facilitate opening the book to the desired page, and means removably securing the plurality of sheets to the book to enable easy assembly of the index marker with the book and removal therefrom for use with another book without damage to the pages of the book or the index marker, said sheets being bound together along one edge thereof to form an index marker spine, each of said sheets including an opening adjacent the index marker spine for receiving the pages of the book and enabling the spine of the index marker to be disposed alongside the exterior of the spine of the book.

4. The index marker as defined in claim 3 wherein said means securing the index marker and book in assembled relation is an elastic member extending between the pages of the book along the interior of the book spine and extending outwardly at each end thereof and connected to the spine of the index marker.

5. The index marker as defined in claim 2 wherein said means securing the sheets to the book includes a fastener extending through the ends of the legs remote from the webs, each fastener including a loop positioned outwardly of the top and bottom edges of the book adjacent the spine, and an elastic member engaged with the loops and extending along the exterior surface of the book spine to retain the index marker on the book.

* * * * *